United States Patent [19]

Schippers et al.

[11] Patent Number: 4,973,007

[45] Date of Patent: Nov. 27, 1990

[54] YARN TRAVERSING SYSTEM

[75] Inventors: Heinz Schippers, Remscheid; Walter Runkel, Wuppertal; Klaus Weber; Friedrich Urbahn, both of Remscheid, all of Fed. Rep. of Germany

[73] Assignee: Barmag AG, Remscheid, Fed. Rep. of Germany

[21] Appl. No.: 377,826

[22] PCT Filed: Oct. 6, 1988

[86] PCT No.: PCT/DE88/00615

§ 371 Date: Jul. 19, 1989

§ 102(e) Date: Jul. 19, 1989

[87] PCT Pub. No.: WO89/03359

PCT Pub. Date: Apr. 20, 1989

[30] Foreign Application Priority Data

Oct. 9, 1987 [DE] Fed. Rep. of Germany ..... 3734225
Mar. 18, 1988 [DE] Fed. Rep. of Germany ..... 3809112

[51] Int. Cl.[5] ..... B65H 54/32; B65H 54/38

[52] U.S. Cl. ..... 242/43 R; 242/18.1; 242/43.1; 242/58 B

[58] Field of Search ..... 242/43 R, 43.1, 18.1, 242/158 B, 158.4 R; 74/37

[56] References Cited

U.S. PATENT DOCUMENTS

| | | | |
|---|---|---|---|
| 1,469,470 | 10/1923 | Wright | 242/158 B X |
| 1,582,107 | 4/1926 | Whiteside | 242/158 B X |
| 2,747,649 | 5/1956 | Reed | 242/158 B X |
| 2,847,859 | 8/1958 | Lynott | 242/158 B X |
| 2,911,835 | 11/1959 | Smith | 242/158 B X |
| 3,029,649 | 4/1962 | Steyh | 242/158 B X |
| 3,039,708 | 6/1962 | Chidgey, Jr. et al. | 242/158 B X |
| 3,067,961 | 12/1962 | Chidgey, Jr. et al. | 242/158 B X |
| 3,093,344 | 6/1963 | Lamb | 242/158 B X |
| 3,400,594 | 9/1968 | Steyh | 242/158 B X |
| 3,716,200 | 2/1973 | Sartori | 242/43 R |
| 4,085,621 | 4/1978 | Hadaway | 242/158 B X |

FOREIGN PATENT DOCUMENTS

| | | | |
|---|---|---|---|
| 1959261 | 6/1971 | Fed. Rep. of Germany . | |
| 2102615 | 8/1972 | Fed. Rep. of Germany . | |
| 2138061 | 1/1973 | Fed. Rep. of Germany . | |
| 2914179 | 10/1980 | Fed. Rep. of Germany | 242/158 B |
| 3444648 | 6/1985 | Fed. Rep. of Germany . | |
| 413448 | 4/1946 | Italy | 242/158 B |
| 346209 | 8/1972 | U.S.S.R. | 242/158 B |
| 1601487 | 10/1981 | United Kingdom . | |

*Primary Examiner*—Stanley N. Gilreath
*Attorney, Agent, or Firm*—Bell, Seltzer, Park & Gibson

[57] ABSTRACT

A yarn traversing apparatus is disclosed which is adapted for guiding a running yarn onto a rotating core to form a core supported package. The apparatus includes a slide mounting a yarn guide, and a conveyor belt having parallel runs for reciprocating the slide. More particularly, the slide is coupled to one of the runs during one traverse and it is then released and coupled to the other of the runs during the opposite traverse. To avoid the loss of kinetic energy during stroke reversals, the slide of the present invention is connected with each run of the drive belt by means of a coupling member, which is positively driven along a curved quick track at each of the ends of the stroke path, and at the traversing speed. By this arrangement, a substantial portion of the kinetic energy of the slide is transmitted from the belt run which is moving toward the reversal zone directly to the oppositely moving run.

22 Claims, 6 Drawing Sheets

YARN TRAVERSING SYSTEM

BACKGROUND OF THE INVENTION

The present invention relates to a yarn traversing apparatus adapted for guiding a running yarn onto a rotating core to form a core supported package.

Yarn traversing apparatus are known which utilize a belt as a linear drive for a traversing yarn guide, note for example U.S. Pat. No. 4,881,694 and DE-OS No. 34 44 648. With such systems, the traversing stroke is easily adjustable and it can also be decreased and increased continuously to produce a stroke modification, and it can also be decreased continuously as a function of the increasing diameter of the package for the production of a package having flattened (bi-conical) end surfaces. However, these systems have a disadvantage in that the reversal of the moved masses at the stroke reversal points involve a substantial loss of kinetic energy.

It is accordingly an object of the present invention to provide a yarn traversing apparatus of the described type which alleviates the problem of substantial losses of kinetic energy resulting from the reversal of the moved masses at the stroke reversal points.

SUMMARY OF THE INVENTION

The above and other objects and advantages of the present invention are achieved in the embodiments illustrated herein by the provision of a yarn traversing apparatus which provides for a coupling member which permits the traversing slide to be alternately connected to one of two parallel linear runs of a conveyor belt drive, and which causes the coupling member to be positively driven along a curved drive track at each of the ends of the stroke path, encompassing about 180°, and driven at the traversing speed. More particularly, the traversing apparatus of the present invention comprises a slide fixedly mounting a yarn guide, conveyor belt means having parallel runs, means for driving the conveyor belt means and so that the runs move in opposite directions, and means mounting the slide for back and forth movement along a linear stroke path parallel to the runs of the conveyor belt means. The apparatus further comprises control means for coupling the slide to one of the runs adjacent one of the ends of the stroke path and for coupling the slide to the other of the runs adjacent the other of the ends of the stroke path, and so that the slide and yarn guide are reciprocated along the stroke path, and with the control means including a coupling member, means interconnecting the coupling member and the slide, a pair of concavely curved guide tracks mounted in spaced apart, opposing relationship and defining respective ends of the stroke path, and means for positively driving the coupling member along the curved guide track at each of the ends of the stroke path at the traversing speed.

In a preferred embodiment, the control means further comprises means mounting at least one of the guide tracks for selective movement toward and away from each other so as to effectively lengthen and shorten the stroke path of the slide. This arrangement permits the winding machine to be designed and constructed such that, during a winding cycle, the traverse stroke can be continuously decreased at one or both ends, or be continuously varied between a maximum and a minimum. As a result of a continuous shortening of the traverse stroke, a package with conical or biconical end faces may be formed. The recurrent variation of the traverse stroke between a maximum value and a minimum value is commonly referred to as "stroke modification". An advantage of the present invention is the fact that as a result of this stroke modification, a ribbon breaking function is also achieved.

The movement of the curved guide tracks, which are positioned at the stroke ends, may be continuously adjusted in the longitudinal direction of the traverse stroke as a function of the increasing diameter (biconical winding) or as a function of time, or the winding diameter, or any other program.

According to the present invention, a substantial portion of the kinetic energy of the moved masses is transmitted in the stroke reversal zones from the one belt run which is moving toward the reversal zone directly to the other run which is moving away from the reversal zone, and thereby converted to a return motion.

In one specific embodiment of the invention, the drive of the coupling member is effected in that the coupling member is in the form of an elongate body of finite length (i.e., a belt, chain, tape, or the like), and which extends over a partial length of the double traverse stroke and performs a continuous, non-braked motion in the reversal zones, and so that it moves at an unreduced speed from the one run to the oppositely moving run, and visa versa at the other stroke reversal zone. Also, the coupling member is always drivingly connected with one of the runs of the belt in a mechanical, magnetic, or electromagnetic manner.

The elongate body of the coupling member is of such a length that, at times, it is drivingly connected in the stroke reversal zones with both of the runs of the belt at the same time. An overlapping of the ends of the body member is avoided in that it has a length less than the distance it moves in the shortest double traverse stroke ($H_{min}$).

The conveyor belt means may comprise a pair of linear belts. Alternatively, the conveyor belt means may be composed of a forwardly moving run and the returning run of an endlessly revolving belt. In this event, the coupling member may be a portion of a chain, a tape, or a belt, and the endlessly revolving belt may extend over several winding positions and traversing strokes.

The desired contact between the coupling member and the runs of the belt may be provided in a mechanical manner, in that a contact pressure guide may be provided between the two runs and which presses the coupling member against each run at least at one location. Likewise, guide rolls may be positioned in the stroke reversal zones, which form the inner guide track of a curved guideway and which serve as contact pressure guides.

In order to prevent relative movement between the coupling member and the contact pressure guides, the latter may be constructed as contact pressure rolls or as an endless belt, which extends and rotates as an island between the runs of the drive belt, and so as to press the coupling member against one or the other of the runs of the drive belt. Relative friction between the coupling member and the inner guideway may also be avoided by constructing the inner guideway as a freely rotatable guide roll.

A constant and tight contact between the coupling member and the runs of the belt may also be accomplished by having the length of the coupling member be greater than the largest possible distance between the deflecting guideway and the next contact pressure guide or between two contact pressure guides, so as to provide that the coupling member is always engaged at two points with one or both of the runs of the belt.

A non-mechanical connection between the coupling member and the runs of the belt may also be provided by magnetic and magnetizable inserts on both elements. This embodiment is advantageous in that it prevents mechanical wear.

The drive for the converyor belt means may comprise an electromagnetic linear drive. These linear drives extend parallel to each other, and are advantageous in that they do not suffer from wear. In this embodiment, the coupling member may comprise, or is provided with an insert of magnetizable material, and the electromagnetic linear drive exerts a linearly propagating electromotive force on the coupling member. Also, the coupling member is guided along the runs of the belt in such a manner that, at the ends of the traverse stroke, it moves into the there provided curved guide track and can be deflected to the other run of the belt.

Another embodiment of a mechanical connection between the runs of the belt and the coupling member, which substantially avoids mechanical friction, involves a stationary guide island which is positioned between the two runs of the belt and which has opposite surfaces which face respective runs in a spaced apart relationship. Further, the coupling member may be in the form of an elongate chain composed of a plurality of interconnected rolls. In this embodiment, the runs of the drive belt move at twice the traversing speed, and the chain mounts a deflecting roll preferably at its leading end and which is located in a plane offset from that of the runs of the belt and the interconnected rolls. Also, the concavely curved guide tracks are located in a corresponding plane, and thus in this embodiment, the deflecting roll moves along the concavely curved guide tracks whereas in the reversal zones, the interconnected rolls of the elongate chain move along the inner reversing guide track which is located in the plane of the runs of the belt and the interconnected rolls.

For the purpose of adjusting the stroke length, the above described guide island may comprise superposed plates, lamellae or the like in at least one longitudinal area, and which overlap and may be displaced relative to each other, without interrupting the guide surfaces which face the runs of the belt.

In the above described embodiments, it is possible that the stroke reversal need not necessarily follow a sine law, but it may follow other laws. To this end, the coupling member may be slidably connected to the slide by means of a transverse slot in the slide and a post connected to the coupling member which is received in the slot. Also, the slot of the slide may be arcuately curved along its length, so that the sinusoidal reversal of the coupling member, when transmitted to the traversing slide, is superposed by additional decelerations and/or accelerations.

In another embodiment of the present invention, the positive drive of the coupling member along the concavely curved guide track at the reversal zones is provided by a drive element, which is positioned at a constant distance from the concavely curved guide track, and which is driven at twice the linear speed of the runs of the belt. In this embodiment, a curved guideway for the coupling member is provided by a stationary surface and a driven surface which is concentric thereto. The driven surface can be positioned on the outside of the passage and be formed by an endless, rotating control belt. Alternatively, the driven surface can be located on the inside of the guideway in which event, it is preferably formed by an endless belt rotating between the traversing stroke ends, or by a rotatably driven roll positioned at each reversal zone. In these embodiments, the coupling member includes a gripper plate having a freely rotatable roll mounted thereon, and which is mounted for movement on the slide in a transverse direction. In the reversal zones, the freely rotatable roll is received between the stationary surface and the driven surface which moves at twice the traversing speed, so that the rotatable roll is moved at the traversing speed along the curved guideway in such a manner that the gripper plate disengages from one of the runs and engages the other run of the drive belt.

Where the drive surface comprises an endlessly rotating control belt, the belt pulleys mounting this belt and which are positioned at the stroke reversal zones, can be adjusted together with the associated inner guide tracks along the traversing stroke, for the purpose for shortening or lengthening the traversing stroke. At the inside of the traversing stroke, the control belt may be guided by deflecting rolls in such a manner that a change in the spacing of the deflecting rolls has no effect on the length of the control belt. To this end, the belt is guided in a W-shape in each moveable reversal zone, so that one run of the endlessly rotating control belt is deflected in each moveable traversing stroke end by a belt pulley, which is displaceable along with the deflecting roller. Also, a further, stationary deflecting roller is positioned out of the traversing stroke zone. In this embodiment, the control belt can extend over a plurality of winding positions and traversing zones, it being possible to vary the traversing strokes independently of each other without changing the overall belt length.

BRIEF DESCRIPTION OF THE DRAWINGS

Some of the objects and advantages of the present invention having been stated, others will appear as the description proceeds, when taken in conjunction with the accompanying drawings, in which.

DETAILED DESCRIPTION OF THE PREFERRED EMBODIMENTS

Figure 1:
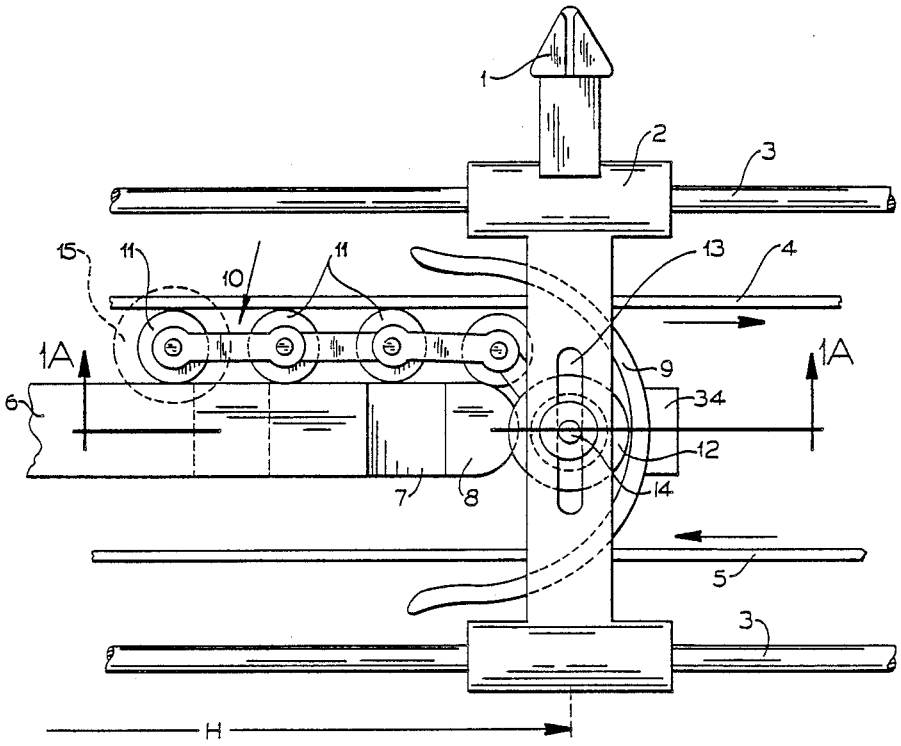
FIG. 1 is a fragmentary front elevation view of a yarn traversing apparatus which embodies the features of the present invention.
Figure 2A:
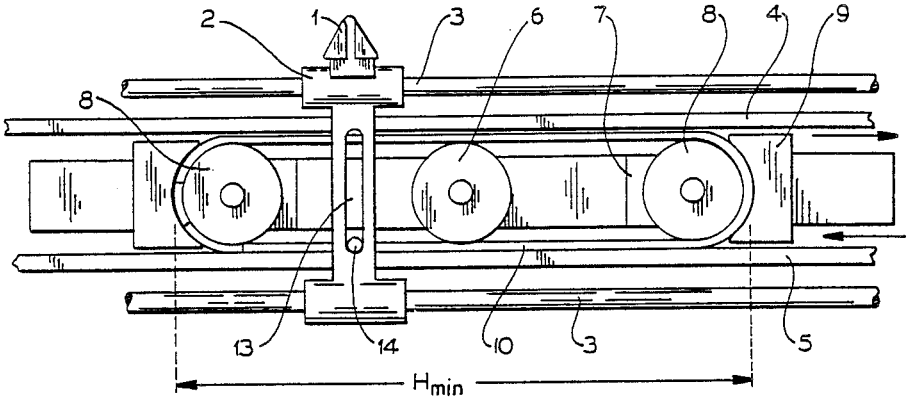
FIGS. 2A and 2B are side elevation views of a second embodiment of the invention, and illustrating the apparatus positioned for producing a minimum and maximum stroke length respectively.
Figure 2B:
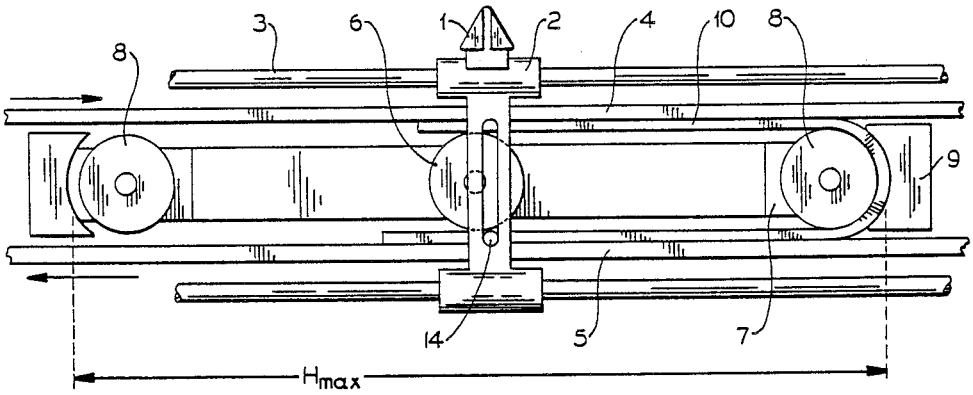
Figure 2C:
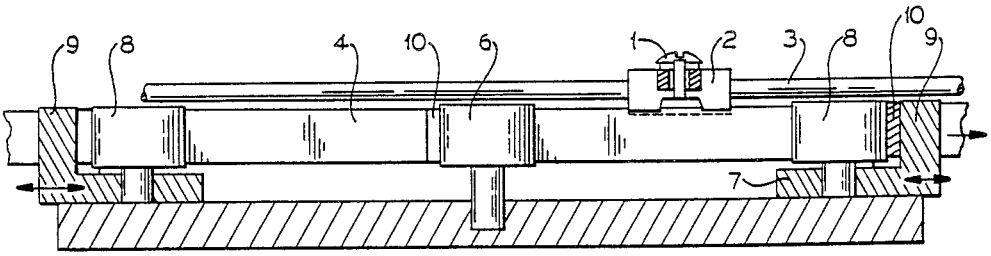
FIG. 2C is a top plan view of the apparatus shown in FIG. 2B.
Figure 3:
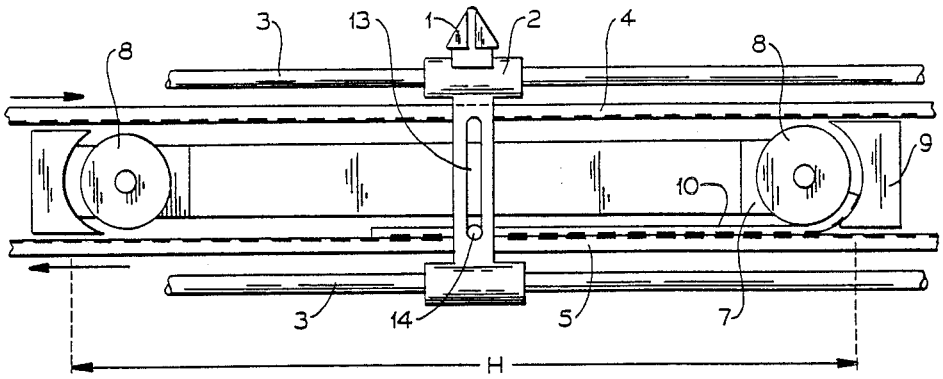
FIG. 3 is a front elevation view of a further embodiment of the present invention.

In the embodiments of FIGS. 1-3, a 2. The slide 2 is guided in a straight line along rods 3. The slide 2 possesses a straight slot 13 extending in a direction perpendicular to the rods 3, which serves as a slotted guide track. Guided in a straight line inside the slotted guide track is a sliding post 14. The sliding post 14 is mounted on a coupling member 10, which may take form of a chain, a belt, a tape, or the like. The coupling member 10 is driven by linear drives 4 and 5, which extend along the straight rods 3 and move in opposite direction. The slotted guide track 13 extends between the two linear drives 4 and 5.

In the embodiment of FIG. 1, the linear drives 4 and 5 are formed by linear belt runs, which can be the forward moving run 4 and the returning run 5 of an endlessly rotating belt. The linear speed of the runs 4 and 5 is twice the predetermined traversing speed.

Located in the center between the linear runs 4 and 5 is a contact pressure guide island, which comprises a stationary portion 6 and a movable portion 7. The contact pressure guide island extends along the two linear belt runs, and the lateral surfaces of the contact pressure guide island form a narrow gap respectively with the linear belt run 4 and the linear belt run 5. Mounted on the end of the movable portion 7 of the contact pressure guide island is a curved guideway, which is defined by an inside convexly curved guide track 8 and an outside concavely curved guide track 9. The outside guide track 9 is mounted to the movable portion 7 by means of the L-shaped bracket 34 as seen in FIGS. 1 and 1A.

The coupling member 10 is a chain of finite length, and which is composed of a plurality of rollers 11 which are supported for free rotation by the links of the chain. Located on the leading end of the chain is the sliding post 14. Arranged on the leading end of the chain and coaxial with the sliding post 14 are, in axially offset, parallel planes, a roller 11 and a freely rotatable deflecting roller 12, as is shown in FIG. 1A. Also located in a plane above the linear runs 4 and 5, but in the same plane as the deflecting roller 12, is the outside guide track 9 in the shape of a nearly semicircular arc, which is open toward the traversing stroke H. The ends of the outside guide track 9 are parallel to the linear runs 4 and 5, respectively, and to the parallel lateral surfaces of the contact pressure guide island 6 and 7, so that at the stroke ends the deflecting roller 12 can smoothly enter into and leave the deflecting guide track 9, without jerks and shocks.

Figure 1A:
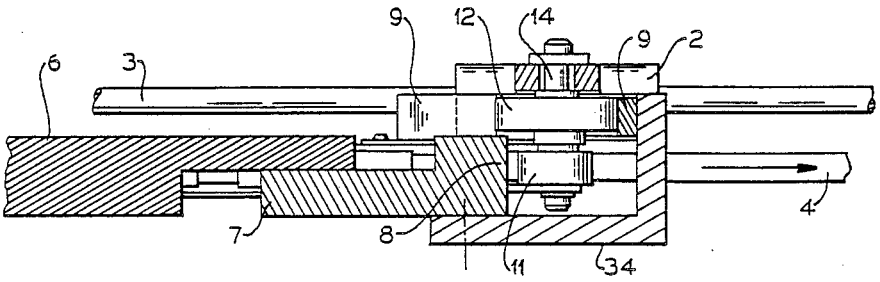
FIG. 1A is a sectional view taken substantially along the line 1A—1A of FIG. 1.

It should explicitly be noted that only the zone of one of the stroke ends is shown in the FIGS. 1 and 1A. Likewise, the other stroke end is provided, in a mirror-inverted arrangement, with a movable portion 7 of the contact pressure island, and with an inside guide track 8 and outside guide track 9.

The traversing yarn guide 1 is driven across the stroke H and put into a reciprocal motion in that the rollers 11 are pressed respectively by the linear belt runs 4 and 5 against the lateral surfaces of the contact pressure island 6, 7, and so as to roll along the surfaces. Consequently, the chain obtains a speed which corresponds to half the linear speed of the linear belt runs 4 and 5. As a result of the fact that in its straight portions the chain is positively connected, via the sliding post 14 and the slotted guide track 13, with the slide 2, the speed of the traversing yarn guide 1 corresponds to the speed of the chain. In the end zones of the traversing stroke H, the deflecting roller 12 rolls along the outer deflecting guide track 9. In so doing, the chain is now pushed by the following rollers 11, until the leading roller 11 enters into the gap between the returning linear belt run 5 and the lower lateral surface of the contact pressure island. While the following rollers 11 are still driven by the forward moving linear belt run 4, the leading rollers 11 are already engaged by the returning linear belt run 5 and driven in the opposite direction. To prevent that after the release of the last roller 11, the end of the chain flies freely around the curve, an additional deflecting roller 15 (shown in dashed lines) can be provided on the axis of the last roller 11. This deflecting roller 15 will be located in the same plane as the deflecting roller 12 and be guided by the external guide track 9 in the stroke reversal zone.

The law of motion, which is followed by the traversing yarn guide 1 when it reverses its direction of movement in the stroke end zone, depends on the separation of the linear belt runs 4, 5, the shape of the outer deflecting guide track 9, and the diameter of the deflecting roller 12. The outer deflecting guide track 9 can be constructed in a shape selected from the functions of a circle, parabola or sine. The diameter of the deflecting roller 12 can be smaller or larger than shown in the drawing, in particular also smaller than that of the rollers 11. The law of motion of the traversing yarn guide 1 can also be influenced by the profiling of the slotted guide track 13, as will be explained hereinbelow with reference to FIG. 2D.

Since both the deflecting roller 12 and the outer deflecting guide track 9 are located in a plane different from the linear belt runs 4 and 5, the lateral surfaces of the contact pressure island 6, 7, and the rollers 11 of the coupling member 10, the outer deflecting guide track 9 and the diameter of the deflecting roller 12 on the one hand and the spacing of the linear belt runs on the other, may be arranged freely within the specified scope.

The stationary portion 6 and the movable portion 7 of the contact pressure island are connected with each other so that the two portions lamellarly overlap, it being possible to displace the lamellae with respect to each other. This arrangement ensures that also in the separating area between the stationary portion 6 and the movable portion 7 of the contact pressure island, the rollers 11 can roll along a continuous surface. As is illustrated in FIG. 1A, the separating plane extends perpendicularly to the axes of the rollers 11, i.e. approximately along the axial center of the rollers 11.

The movable portion 7 may be adjustably displaced with respect to the stationary portion 6 in opposite directions parallel to the direction of the drive belts 4, 5, by any suitable power means such as a fluid cylinder. Such displacement of the movable portion 7 of the contact pressure island and the inner deflecting guide track 8 permits the stroke length H to be adjusted, so as to modify the stroke (a reversing shortening and lengthening of the stroke), or to produce biconical packages (continuous shortening of the stroke during the beginning or during the entire course or a part thereof or during the end of a winding cycle). It should especially be noted that in this apparatus, a ribbon breaking occurs simultaneously with a stroke modification, since as a result of the latter the ratio of winding speed to traversing frequency, which is decisive for the ribbon breaking in a random wind, is also changed.

In the embodiment of FIGS. 2A–D, the linear drives are again formed by linear belt runs 4 and 5, which are oppositely driven at the traversing speed. They can again comprise a forward moving run 4 and a returning run 5 of an endlessly rotating belt. Located between the two linear belt runs 4 and 5 is a stationary contact pressure guide in the form of a freely rotatable pressure roll 6 and a movable contact pressure guide 7, on which also an internal deflecting guide track 8 is arranged in the form of a freely rotatable guide roll 8 as well as an external deflecting guide track 9 in the form of a bow. The pressure roll 6 and the guide rolls 8 have the same diameter. Furthermore, additional pressure rolls (not shown) having the same diameter as the pressure roll 6 can be arranged on the movable contact pressure guide 7. The linear coupling member 10 has here the form of an endless belt, the leading end of which accommodates sliding post 14, which engages in the slotted guide track 13 of the slide 2. The coupling belt 10 is pressed by pressure rolls 6 and the guide rolls 8 against the linear belt run 4 and driven by same. In the illustrated embodiment, the pressure rolls 6 and the guide rolls 8 have a diameter, which corresponds substantially to the distance between the linear belt runs 4 and 5. Consequently, the pressure rolls 6 and guide rolls 8 effect an engagement of the coupling belt 10 with the two linear belt runs 4 and 5. However, it is also possible to provide for the clamping of the coupling belt 10 against the linear belt runs 4 and 5 by means of freely rotatable pressure rolls which have a smaller diameter and which are respectively associated only to one of the belt runs.

The length of the coupling belt 10 is greater than the greatest distance occurring at the maximum stroke between two successive pressure rolls 6, or two successive pressure and guide rolls, and greater than half the circumference of the guide rolls. This ensures that the belt is always in line contact with one of the linear belt runs 4 or 5, and that, in the reversal zone, it is moved forward by the one linear belt run 4 as well as already simultaneously returned by the other linear belt run 5.

Illustrated in FIG. 2B is the position of the guide rolls 8 at a maximum traverse stroke $H_{max}$. The coupling belt 10 is at least as long as the distance between the pressure roll 6 and the guide roll 8. In the illustrated embodiment, it is twice as long as this distance. As is shown in FIG. 2A, the distance between the guide rolls 8 can nevertheless be reduced, so that a minimum traversing stroke $H_{min}$ results. To prevent an overlapping of the belt ends at the shortest traversing stroke, the coupling belt is shorter than the sum of the double traversing stroke and the circumference of the guide roll less the diameter of the deflecting roll. To guide the coupling belt, the contact pressure island can again have lateral surfaces, which are adjacent to the linear belt runs 4 and 5. In the present application, a double stroke is understood to be one forward motion plus one return motion of the traversing yarn guide.

In the present embodiment, the law of motion of the traversing yarn guide in the reversal zones is defined by the diameter of the guide roll 8. Variations of the law of motion are made possible in that a rigid deflecting guideway with a specifically designed path is provided as a curved track. It is also possible to provide along a specifically designed deflecting path individual rolls with a smaller diameter for the deflection of the coupling belt 10.

Figure 2D:
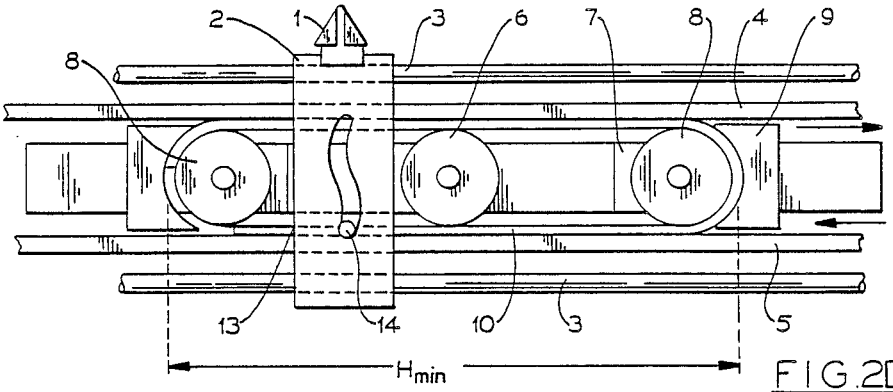
FIG. 2D is a front elevation view similar to FIG. 2A, but illustrating a modified configuration for the slot in the traversing slide.

As to the embodiment of FIG. 2D reference can be made to the foregoing description. It should, however, be emphasized that here the slotted guide track 13 is curved in S-shape. If in this design of the slotted guide track 13, the slide moves to the left and the coupling member 10 with the sliding post 14 moves into the circular curved track on the left, the sliding post 14 will perform a sinusoidal motion in the traversing direction. However, since it simultaneously moves along the curved guide track 13, it imparts, in the illustrated case, to the slide 2 a relative additional movement to the left during its movement through the first quarter of the slotted guide track 13, a relative movement to the right as it moves through the second and third quarters of the slotted guide track, and again a relative movement to the left during its passage through the last quarter of the slotted guide track.

Thus, the profiling of the slotted guide track 13 allows to superpose the sinusoidal law of motion per se by another law of motion, so that a suitable traversing motion is obtained for the slide. It should explicitly be emphasized, that such a profiling of slotted guide tracks also applies to the embodiments of FIGS. 1 and 3.

In the embodiment of FIG. 3, the sliding post 14 is again located on a coupling belt 10. The drive of the coupling belt 10 is effected by linear belt runs 4 and 5, which may be again the strands of an endlessly rotating belt. The linear belt runs 4 and 5 as well as the coupling belt 10 possess magnetic inserts, which ensure that the coupling belt 10 closely contacts the linear belt runs 4 and 5 in a frictional engagement. The outer deflecting guide track 9 is here designed in a manner that it projects with its one pointed corner into the angle formed between the inner deflecting guide roll 8 and the forward moving linear belt, thereby disengaging the coupling belt 10 against the magnetic holding forces from the linear belt run 4. Again, the inner and outer deflecting guide tracks are movable at least on one side between the end points of a maximum traversing stroke and a minimum traversing stroke. Again, the inner deflecting guide rolls 8 are freely rotatable, the diameter of which corresponds substantially to the distance between the belt runs 4 and 5.

Figure 4A:
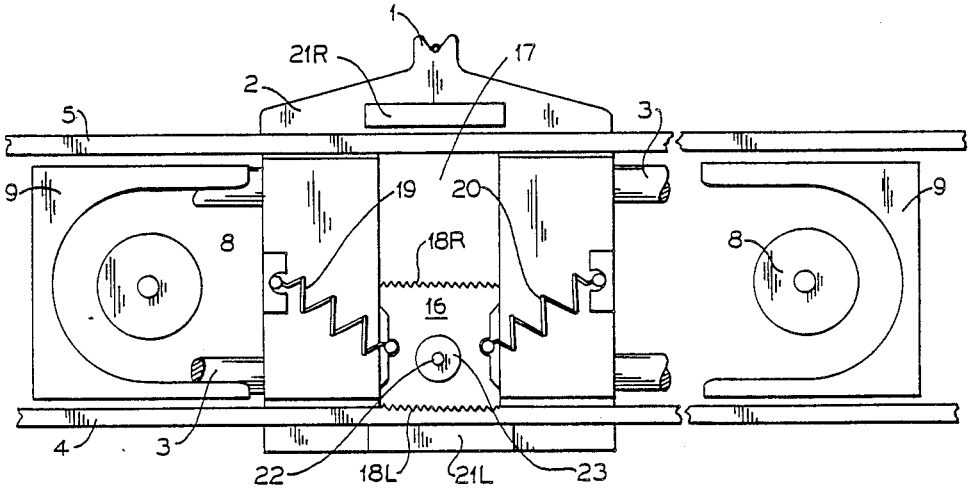
FIGS. 4A and 4B are front elevation views of further embodiments of the present invention.
Figure 4B:
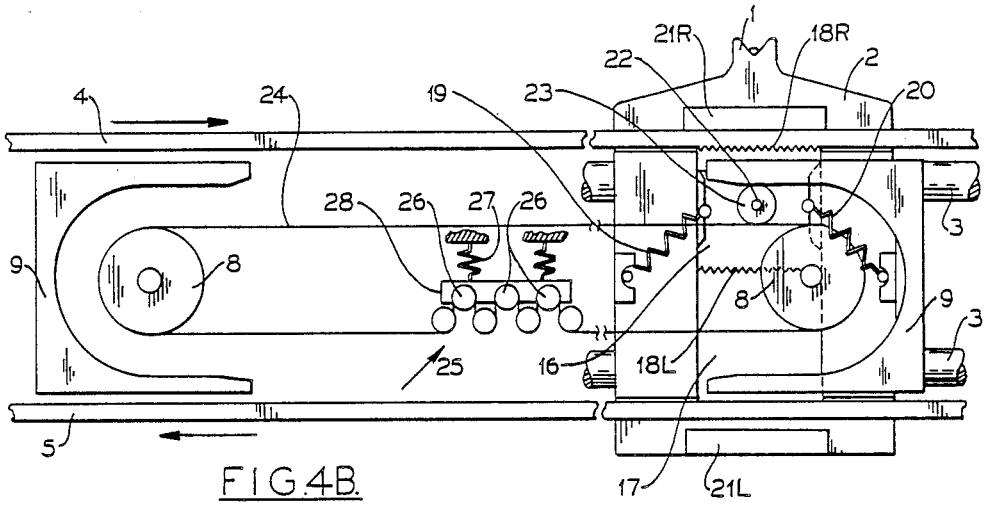
Figure 4C:
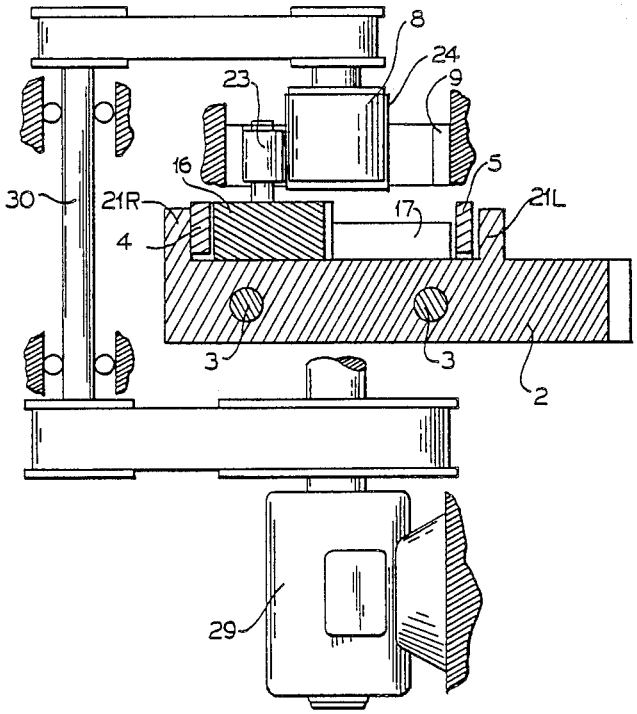
FIG. 4C is a sectional end view of the embodiment of FIG. 4B.
Figure 5:
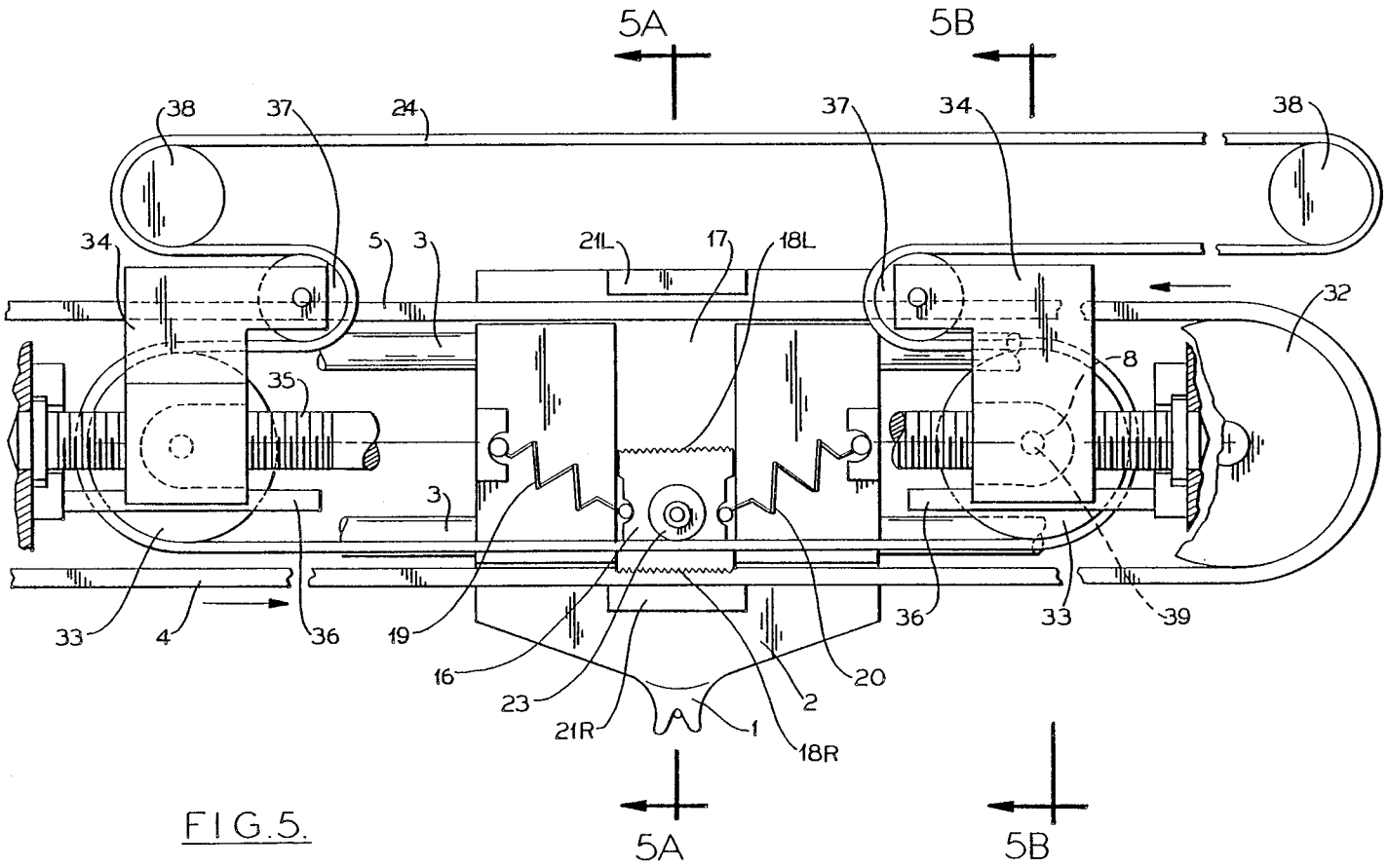
FIG. 5 is a front elevation view of still another embodiment of the present invention.

In the embodiments of FIGS. 4A, 4B, 4C and 5, the linear drives are formed by linear belt runs 4 and 5, which are driven in opposite directions of movement and at the traversing speed. They may be the runs of an endlessly rotating belt, which extends over several traversing positions. A traversing slide 2 is guided in a straight line along rods 3, and the slide mounts on its front end a traversing yarn guide 1. A gripper plate 16 is mounted on the slide 2 for slidably movement along a track 17 and in a direction transverse to the direction of the runs 4,5 and the rods 3. On its opposite ends, the gripper plate 16 is provided with jaws 18R and 18L, and slide 2 mounts shoulders 21L and 21R which oppose the jaws 18L and 18R on the gripper plate respectively. The gripper plate 16 is pressed by compression springs 19 and 20 toward its end positions, with the springs 19 and 20 being supported on the slide 2 in such a manner that its mounting point lies on the center line between the two linear belt runs 4, 5. Consequently, when the gripper plate passes through its center position, the springs 19, 20 are in their dead center position and reverse their operative force applied to the gripper plate 16. In its end positions, the gripper plate pushes the belt run 4 or 5 respectively against the shoulder 21R or 21L. As a result, the gripper plate produces a force-locking connection between the slide 2 and the belt run. A suitable toothing system on the jaws 18L, 18R of the gripper plate will produce a reliable drive connection. Perpendicularly arranged on the gripper plate 16 is an axis 22 of a freely rotatable roll 23. Up to this point, the embodiments of FIGS. 4A, 4B and 5 are identical.

In the embodiment of FIG. 4A, the curved guideway arranged in each reversal zone and displaceable in the direction of the traversing stroke, comprises on the one hand a stationary deflecting guide track 9 and on the other hand a rotatably driven guide roll 8 as an inner deflecting guide track. The outer deflecting guide track 9 extends with a semicircular arc from the one belt run 4 to the other belt run 5 in such a manner that its outlet end portions form a tangent to the roll 23, when the roll 23 and the gripper plate 16 are in one of the end positions. The guide roll 8 is arranged concentrically to the arc of the outer deflecting guide track 9. Both guide rolls 8 are driven at a circumferential speed which is twice the traversing speed. The diameter of the guide rolls 8 is so large that the circumference of each guide roll 8 forms with the outer deflecting guide track 9 a guideway having a width which is about the same as the diameter of roll 23 on the gripper plate 16. The guide roll 8 and outer deflecting guide track 9 are associated to each reversal zone and mounted on a common support located in the same plane as roll 23, which lies above the belts 4 and 5.

In operation, the gripper plate 16 is pressed by springs 19, 20 respectively toward one of the end positions. As a result a force-locking connection is established between the respective belt run and the slide. In the illustrated case, the slide moves to the right. As it moves into the reversal zone, the roll 23, which is supported on the gripper plate 16, enters tangentially into the guideway between the circumference of roll 8 and the outer deflecting guide track 9. This results in the roll 23 being driven by the circumference of the roll 8 at twice the traversing speed. Consequently, the roll 23 moves along the outer deflecting guide track and is imparted a linear speed which corresponds to the linear speed of the belt 4 or 5. While in the guideway between the guide roll 8 and the external deflecting guide track 9, the roll is simultaneously imparted a movement in the direction of the guide track 17 of the slide 2. As a result, the gripper plate 16 is raised from the belt run 4 and placed against the belt run 5 moving to the left, when the roll 23 moves out of the guideway between the guide roll 8 and the outer deflecting guide track 9. As a result, the slide 2 then becomes frictionally or positively engaged with the belt run 5 moving to the left, and is carried along by same to the other reversal zone, where the same operations repeat themselves in the reversed direction.

The embodiment of FIGS. 4B and 4C comprises a stationary, outer deflecting guide track 9 and a guide roll 8 arranged in each reversal zone. The guide rolls are driven at a circumferential speed, which corresponds to twice the traversing speed. Placed about the two guide rolls 8 is an endlessly rotating control belt 24, which is held under tension by a tensioning device 25. The tensioning device comprises two or more stationary, freely rotatable tensioning rolls for the control belt. Between the stationary tensioning rolls, the control belt is deflected by movable tensioning rolls 26 from its straight-line direction. The movable tensioning rolls 26 are supported on a support 28, which is movable by a tensile force, for example, the force of springs 27. Each guide roll 8 and its associated outer deflecting guide track 9 are arranged concentrically to each other, with the deflecting guide track 9 describing a semicircle. The radii and diameters of the guide roll 8 with control belt 24 and the outer deflecting guide track 9 are so dimensioned that between the two a guideway is formed having the width of the diameter of roll 23 supported on gripper 16. Each guide roll 8 and its associated outer deflecting guide track 9 are arranged on a common support, which is movable in the direction of the traversing stroke. The change in the length of the control belt 24 which needs to be compensated to this end, is accomplished by the tensioning device 25.

It should be noted that the guide rolls 8, deflecting guide tracks 9 as well as the roll 23 mounted on the gripper plate 16 are located in a common plane, which is offset from the plane of the two belt runs 4 and 5.

A motor 29 serves to drive the guide rolls 8. Likewise, the motor serves to drive the endlessly rotating belt runs 4, 5. The necessary transmission ratio is established by an intermediate shaft 30. The intermediate shaft 30 is so arranged, and the belt connection to the guide roll is so designed that the guide roll 8 has the freedom of movement necessary to shorten or lengthen the stroke.

In operation, the positive engagement of the belt run 4 as illustrated in FIGS. 4B and 4C, between the shoulder 21R stationarily mounted on the slide and the gripper plate 16, results in the slide being moved by the belt to the right. In so doing, the roll 23 is constantly driven at twice the traversing speed, due to its contact with the control belt 24. In the stroke reversal zones, the roll 23 moves tangentially into the flanks of the outer deflecting guide track 9.

As a result thereof, the roll moves along the outer deflecting guide track 9. Since the guideway between the guide roll 8 and the outer deflecting guide track 9 has also a component in direction of movement of the gripper plate 16, the gripper plate 16 disengages from the belt run 4 and is moved in the direction toward the other belt run 5. In so doing, also the roll 23 is moved on at the traversing speed by the control belt 24 serving as a drive surface. Finally, the gripper plate reaches its clamping position with the belt run 5. Now, the carriage is moved by belt run 5 in the opposite direction.

Figure 5A:
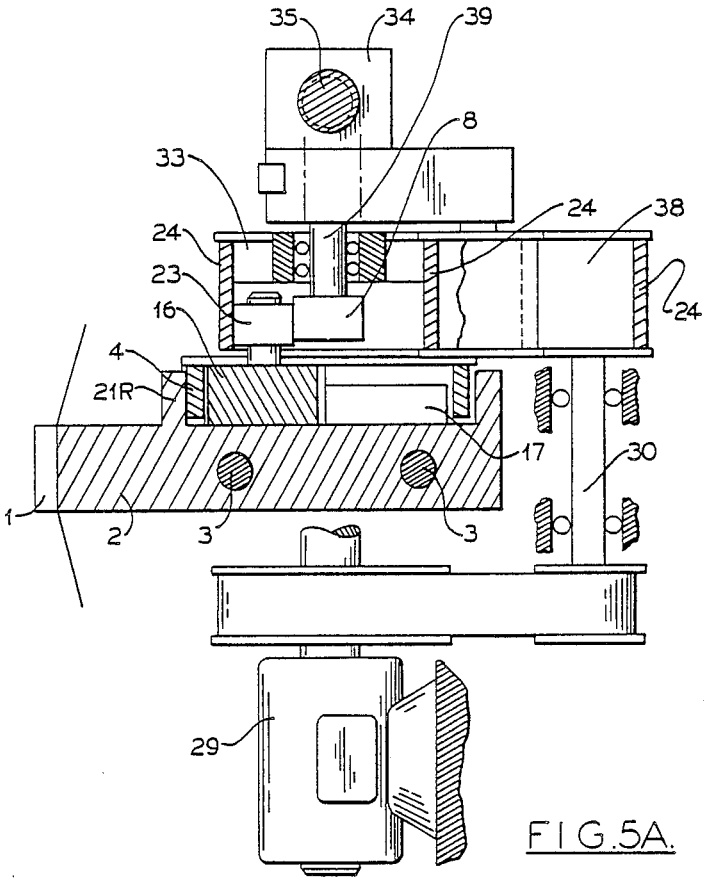
FIGS. 5A and 5B are fragmentary sectional views taken substantially along the lines 5A—5A of FIG. 5 and 5B—5B of FIG. 5 respectively.

FIG. 5 shows in addition one of the deflecting pulleys 32, which deflects the endlessly rotating belt 4, 5 at its end. In each stroke reversal zone, a belt pulley 33 is rotatably supported on a carrier 34. The carriers 34 are supported on a threaded spindle 35, and move along guideways 36 and are secured against rotation. The spindle 35 has threads with an opposite pitch, which is associated to each carrier 34, and the spindle 35 is rotatably driven by any suitable power means (not shown). Such rotation of the spindle 35 thereby causes the belt pulleys 33, and thus the guides 8, to move toward or away from each other so as to effectively lengthen or shorten the stroke path of the slide 2. Each carrier 34 further accommodates a rotatable deflecting roll 37. Stationarily arranged on the machine frame are deflecting rolls 38. As best seen in FIG. 5A, one of the deflecting rolls 38 is driven, via an intermediate shaft 30, by the motor 29, which also serves to drive the deflecting roll 32 of the belt 4, 5. An endless control belt 24 extends over both the pulleys 33 and the deflecting rolls 37 and 38 in such a manner that the belt loops about the pulleys 33 at 180°. One belt strand extends directly between the pulleys 33, and the other belt strand is deflected by belts pulleys 37 and 38 at respectively 180°, before the belt ends meet each other. This W-shape guidance of the control belt 24 accomplishes in the stroke end that the traversing stroke, which is defined by the distance between the belt pulleys 33, can be varied, without changing the belt length. This arrangement is based upon the fact that, for example, a shortening of the distance between the pulleys 33 leads also to a shortening of the belt strand which extends directly between the pulleys 33. The belt strand which extends between the deflecting pulley 37 mounted on carrier 34, and the stationary deflecting pulley 38, is however lengthened to the same extent, so that the total length of the belt 24 tensioned between the pulleys 33, 37, 38 does not change.

Figure 5B:
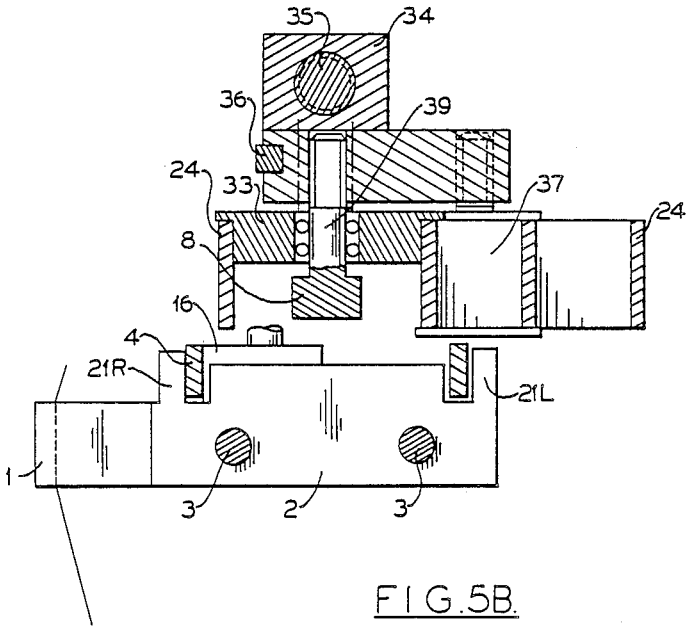

Each carrier 34 further mounts an inner deflecting guide track 8 having a semicircular guide surface, which is mounted on a rigid shaft 39 concentric to the belt pulley 33, but is nonrotating. This means that the belt pulley 33 is supported for free rotation on the rigid shaft 39 of the inner deflecting guide track 8. As can be seen in FIGS. 5A and 5B, the width of control belt 24 is greater than the width of the belt pulley 33. Consequently, the portion of the control belt 24 which loops about the pulley 33 forms with the inner deflecting guide track 8 a semicircular guideway. The width of this guideway corresponds to the diameter of the roll 23 rotatably supported on the gripper 16.

It should be noted that the control belt 24 with its deflecting elements 33, 37, 38 is located in a plane on the underside of the carrier 34. The roll 23 is supported on the upper side of the gripper plate 16 in the same plane as the underside of the control belt 24. The motor 29, which also drives the endlessly rotating belt 4, 5, serves to drive the control belt 24. The necessary transmission ratio is established through an intermediate shaft 30, which is fixedly connected with one of the stationary deflecting pulleys 38. The transmission ratio is such that the control belt 24 is driven at twice the traversing speed.

In operation of the embodiment illustrated in FIG. 5, the slide 2 is moved to the right by the clamping engagement of belt run 4 between the jaw 18R of the gripper plate 16 and the shoulder 21R. In so doing, the roll 23 also contacts the inside of the control belt 24. Consequently, an absolute speed is imparted to the circumference of the roll 23 which is twice the traversing speed. When moving into the right-hand stroke reversing zone, the circumference of the roll 23 tangentially contacts the inner deflecting guide track 8, thereby clamping the roll between the inner deflecting guide track 8 and the inside of the exposed loop of the control belt 24. Now, the roll 23 follows the inner deflecting guide track 8 and, in so doing, is moved on at the traversing speed. Since the guideway between the inner deflecting guide track 8 and the control belt 24 also has a component in the direction of the guide track 17, the gripper plate 16 is disengaged from the belt run 4 and finally placed against the belt run 5. Now, the slide is moved in the opposite direction, i.e. to the left, until the same procedure repeats itself in the other stroke end.

In the drawings and specification, there has been set forth a preferred embodiment of the invention, and although specific terms are employed, they are used in a generic and descriptive sense only and not for purposes of limitation.

That which is claimed is:

1. A yarn traversing apparatus adapted for guiding a running yarn onto a rotating core to form a core supported package, and comprising a slide fixedly mounting a yarn guide, conveyor belt means having parallel runs, means for driving said conveyor belt means and so that the runs move in opposite directions, means mounting said slide for back and forth movement along a linear stroke path parallel to said runs of said conveyor belt means, control means for coupling said slide to one of said runs adjacent one of said ends of said stroke path and for coupling said slide to the other of said runs adjacent the other of said ends of said stroke path, and so that said slide and yarn guide are reciprocated along said stroke path, and with said control means including (a) a coupling member, (b) means interconnecting said coupling member and said slide, (c) a pair of concavely curved guide tracks mounted in spaced apart, opposing relationship and defining respective ends of said stroke path, and (d) means for positively driving said coupling member along the curved guide track at each of said ends of said stroke path at said traversing speed.

2. The yarn traversing apparatus as defined in claim 1 wherein said control means further comprises means mounting at least one of said guide tracks for selective movement toward and away from the other of said guide tracks so as to effectively lengthen and shorten the stroke path of said slide.

3. The yarn traversing apparatus as defined in claim 1 wherein said means interconnecting said coupling member and said slide comprises means slidably connecting said coupling member to said slide so as to permit slidable movement with respect to said slide along a direction generally perpendicular to the direction of said runs of said conveyor belt means.

4. The yarn traversing apparatus as defined in claim 3 wherein said means slidably connecting said coupling member to said slide comprises a transverse slot in said slide, and a post connected to said coupling member and slidably received in said slot.

5. The yarn traversing apparatus as defined in claim 4 wherein said slot in said slide is arcuately curved along its length such that during reversal of movement an acceleration and/or deceleration is imparted to said coupling member which is independent from that imparted by said pair of guide tracks.

6. The yarn traversing apparatus as defined in claim 1 wherein said coupling member includes an elongate body, and wherein said means for positively driving said coupling member comprises a guide surface means positioned intermediate said runs for supporting said elongate body in contact with the associated run.

7. The yarn traversing apparatus as defined in claim 6 wherein said elongate body member has a length longer than the length of each of said curved guide tracks, but less than twice the sum of the lengths of one of the curved guide tracks and one of said runs, and such that the elongate body is supported in contact with each run during movement thereof along such run and along the entire length of the curved guide track at the downstream end of such run.

8. The yarn traversing apparatus as defined in claim 6 wherein said guide surface means comprises a stationary guide island having opposite surfaces which face respective runs in a spaced apart relationship and so as to receive said elongate body therebetween.

9. The yarn traversing apparatus as defined in claim 8 wherein said guide surface means further comprises a convexly curved guide track at each end of said guide island, with each convexly curved guide track having an arcuate surface which extends over about 180 degrees and merges with said opposite surfaces, and wherein the arcuate surface of each convexly curved guide track is opposed to and spaced inwardly from the adjacent concavely curved guide track.

10. The yarn traversing apparatus as defined in claim 9 wherein said elongate body comprises a plurality of interconnected, freely rotatable rollers which are sized to be closely received between said opposite surfaces and said runs, and such that the linear speed of said runs is twice the speed of the traverse of said slide.

11. The yarn traversing apparatus as defined in claim 10 wherein each of said concavely curved guide tracks is laterally offset from said guide island, and wherein said elongate body includes a deflecting roll at one end thereof which is positioned to engage each of said concavely curved guide tracks.

12. The yarn traversing apparatus as defined in claim 6 wherein said guide surface means comprises a plurality of contact rolls mounted for rotation between said runs of said conveyor belt means, and with said contact rolls being positioned so as to press said elongate body into contact with said runs.

13. The yarn traversing apparatus as defined in claim 6 wherein said guide surface means comprises magnetic means mounted to said conveyor belt means and said elongated body for releasably holding the same in engagement.

14. The yarn traversing apparatus as defined in claim 1 wherein said coupling member comprises a gripper plate mounted on said slide for slidable movement between a first position engaging one of said runs of said conveyor belt means and a second position engaging the other of said runs, and such that said slide and yarn guide are reciprocated along said stroke path at a traversing speed corresponding to the linear speed of said runs.

15. The yarn traversing apparatus as defined in claim 14 wherein said coupling member further comprises a freely rotatable roll mounted to said gripper plate for rotation about an axis which is perpendicular to the direction of said runs, and with said roll being positioned for engagement by said pair of curved guide tracks so as to alternately slide said gripper plate between said first and second positions.

16. A yarn traversing apparatus adapted for guiding a running yarn onto a rotating core to form a core supported package, and comprising a slide fixedly mounting a yarn guide, conveyor belt means having parallel runs, means for driving said conveyor belt means and so that the runs move in opposite directions, means mounting said slide for back and forth movement along a linear stroke path parallel to said runs of said conveyor belt means, control means for coupling said slide to one of said runs adjacent one of said ends of said stroke path and for coupling said slide to the other of said runs adjacent the other of said ends of said stroke path, and so that said slide and yarn guide are reciprocated along said stroke path at a traversing speed corresponding to the linear speed of said runs of said conveyor belt means, said control means comprising (a) a gripper plate mounted on said slide for slidable movement between a first position engaging one of said runs of said conveyor belt means, and a second position engaging the other of said runs, (b) a freely rotatable roll mounted to said gripper plate for rotation about an axis which is perpendicular to the direction of said runs, (c) a pair of concavely curved outer guide tracks mounted in spaced apart, opposing relationship along said stroke path and so as to define respective opposite ends of said stroke path, and a pair of convexly curved inner guide tracks mounted adjacent respective ones of said outer guide tracks so as to define a generally semi-circular guideway therebetween, and with said guideway being sized to closely receive said roll therethrough, and (d) means for rotatably driving one of said guide tracks of each associated adjacent pair while supporting the other of each pair stationary, and with the rotatably driven guide track moving at a speed twice the speed of said runs, and such that said roll is adapted to enter and be positively moved through one of said guideways and so as to move said gripper plate from said first position to said second position, and to enter and be positively moved through the other of said guideways and so as to move said gripper plate from said second position to said first position.

17. The yarn traversing apparatus as defined in claim 16 wherein said control means further comprises spring biasing means fixed between said slide and said gripper plate for biasing said plate toward said first position when said plate is in said first position, and for biasing said plate toward said second position when said plate is in said second position, and with said spring biasing means having a dead center position of maximum force when said plate is intermediate said first and second positions.

18. The yarn traversing apparatus as defined in claim 17 wherein said control means further comprises a pair of clamping shoulders fixed to said slide at laterally spaced apart locations and so that one of said clamping shoulders and said gripper plate grip therebetween one of said runs when said gripper plate is in said first position, and the other of said clamping shoulders and said gripper plate grip the other of said runs therebetween when said gripper plate is in said second position.

19. The yarn traversing apparatus as defined in claim 18 wherein each of said pair of convexly curved inner guide tracks comprises a rotatable roller, and said means for rotatably driving one of said guide tracks comprises means for rotatably driving each of said rollers.

20. The yarn traversing apparatus as defined in claim 19 further comprising an endless control belt entrained about said rollers and so as to be rotated therewith, and wherein said rollers have a diameter greater than that of said freely rotatable roll on said gripper plate.

21. The yarn traversing apparatus as defined in claim 16 wherein said pair of concavely curved outer guide tracks comprises a pair of belt pulleys, and an endless control belt disposed about said pair of belt pulleys with said endless control belt extending axially to one side of the periphery of said belt pulleys so that its inside surface defines a concave surface which extends for about 180 degrees, wherein said means for rotatably driving one of said guide tracks comprises means for rotating said endless control belt and said belt pulleys, and wherein said pair of convexly curved inner guide tracks comprises a non-rotatable guide roll positioned coaxially with respective ones of said belt pulleys and within the associated concave surface defined by said control belt passing over the associated belt pulley.

22. The yarn traversing apparatus as defined in claim 21 further comprising means mounting said belt pulleys for selective movement toward and away from each other so as to effectively lengthen and shorten the stroke path of said slide, and means mounting said control belt such that movement of said belt pulleys toward and away from each other does not change the length of said control belt.

* * * * *

UNITED STATES PATENT AND TRADEMARK OFFICE

CERTIFICATE OF CORRECTION

PATENT NO. : 4,973,007

DATED : November 27, 1990

INVENTOR(S) : Heinz Schippers et al

It is certified that error appears in the above-identified patent and that said Letters Patent is hereby corrected as shown below:

Column 5, line 4, after "a" insert -- traversing yarn guide 1 is fixedly mounted on a slide --.

Signed and Sealed this

Seventh Day of July, 1992

*Attest:*

DOUGLAS B. COMER

*Attesting Officer*

*Acting Commissioner of Patents and Trademarks*